US006953129B2

(12) United States Patent
DeLay

(10) Patent No.: US 6,953,129 B2
(45) Date of Patent: Oct. 11, 2005

(54) PRESSURE VESSEL WITH IMPACT AND FIRE RESISTANT COATING AND METHOD OF MAKING SAME

(75) Inventor: Thomas K. DeLay, Huntsville, AL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 72 days.

(21) Appl. No.: 10/231,428

(22) Filed: Aug. 27, 2002

(65) Prior Publication Data

US 2004/0040969 A1 Mar. 4, 2004

(51) Int. Cl.[7] ..... F17C 1/06
(52) U.S. Cl. ..... 220/589; 220/590; 220/562
(58) Field of Search ..... 220/589, 581, 220/586, 588, 590, 591, 592, 562, 62.15, 62.19, 62.22

(56) References Cited

U.S. PATENT DOCUMENTS 3,969,812 A 7/1976 Beck
4,699,288 A 10/1987 Mohan
4,767,017 A 8/1988 Logullo, Sr. et al.
5,177,969 A 1/1993 Schneider
5,287,988 A 2/1994 Murray
5,476,189 A 12/1995 Duvall et al.
5,653,358 A 8/1997 Sneddon
5,822,838 A 10/1998 Seal et al.
5,942,070 A 8/1999 Park et al.
6,190,481 B1 2/2001 Iida et al.
6,207,738 B1 * 3/2001 Zuckerman et al. ..... 524/156

FOREIGN PATENT DOCUMENTS

GB 1114651 A1 * 5/1968

* cited by examiner

*Primary Examiner*—Stephen Castellano
(74) *Attorney, Agent, or Firm*—James J. McGroary; Ross F. Hunt, Jr.

(57) ABSTRACT

An impact and fire resistant coating laminate is provided which serves as an outer protective coating for a pressure vessel such as a composite overwrapped vessel with a metal lining. The laminate comprises a plurality of fibers (e.g., jute twine or other, stronger fibers) which are wound around the pressure vessel and an epoxy matrix resin for the fibers. The epoxy matrix resin including a plurality of microspheres containing a temperature responsive phase change material which changes phase in response to exposure thereof to a predetermined temperature increase so as to afford increased insulation and heat absorption.

8 Claims, 1 Drawing Sheet

PRESSURE VESSEL WITH IMPACT AND FIRE RESISTANT COATING AND METHOD OF MAKING SAME

ORIGIN OF THE INVENTION

This invention was made by employees of the United States Government and may be manufactured and used by or for the Government for governmental purposes without the payment of any royalties.

FIELD OF THE INVENTION

The present invention relates to pressure vessels and, more particularly, to pressure vessels made of composite materials and to methods for making such vessels.

BACKGROUND OF THE INVENTION

The advent of advanced composite materials has enabled the development of pressure vessels of light weight and having very thin walls. Such lightweight vessels made with composite materials are useful in many applications. However, an important disadvantage of such vessels is that the composite materials are easily damaged by impact and do not perform well in high temperature environments.

It will be appreciated that pressure vessels made for many applications, such as the containment of natural gas, for use in automobiles, and the like, must be designed and manufactured in accordance with prescribed standards and, particularly with respect to automobiles and trucks, must meet the strict standards, and comply with the test methods, set by the U.S. Department of Transportation (DOT). For example, such vessels must be resistant to damage and vented during fire so that the vessels do not explode. As indicated above, composite pressure vessels and tanks are, in general, not very damage tolerant. Moreover, damage to such vessels can be difficult to detect during normal inspection procedures, and the damage caused by even a small impact to such a vessel can have a large effect on performance and safety.

Cost is also a factor, particularly in, e.g., the automobile industry, and thus there is a need for an inexpensive way in which to protect pressure vessels and/or to produce pressure vessels providing both impact resistance and fire resistance.

Considering patents of interest here, U.S. Pat. No. 3,969,812 to Beck discloses pressure vessels of the type wherein a thin, lightweight metallic liner is completely overwrapped by a plurality of layers of single-glass filaments.

U.S. Pat. No. 4,699,288 to Mohan discloses a high pressure vessel construction including a plurality of layers of resin impregnated graphite fibers and a plurality of layers of a hybrid of resin impregnated glass and polymer fibers, with the glass and polymer fiber layers alternating with the graphite fiber layers. A layer of elastomer material is joined to the interior surface of the innermost layer of fibers, and a layer of stiff composite material is joined to the interior surface of the elastomer layer.

U.S. Pat. No. 4,767,017 to Logullo, Sr. et al discloses a filament-wound pressure vessel constructed of a rigid composite of an epoxy resin matrix reinforced with continuous filaments of a p-aramid coated with an adhesion modifier.

U.S. Pat. No. 5,177,969 to Schneider discloses a thermochemical actuation method and apparatus wherein a plurality of fins define thin passages that are filled with a material that expands as it changes from a solid to a fluid state.

U.S. Pat. No. 5,287,988 to Murray discloses a metal-lined pressure vessel wherein the outer shell is fabricated of a generally known composite reinforcement made of fiber reinforcing material in a resin matrix. The fiber may be fiber glass, an aramid carbon, graphite, or any other generally known fibrous reinforcing material. The resin matrix may be epoxy, polyester, vinylester, thermoplastic or any other suitable resinous material capable of providing the structural integrity required for the particular application in which the vessel is to be used.

U.S. Pat. No. 5,476,189 to Duvall et al discloses a pressure vessel including a damage mitigating material integrated within the outer shell. The major thickness of the shell is disposed inside the damage mitigating material and a minor thickness of the shell being disposed outside the damage mitigating material. The damage mitigating material or element is a rigid closed cell foam material and may be made of a wide variety of materials including thermoplastics, thermosets, organic or inorganic fibers, rubber, metals, papers, glass, open or closed cell foams, woven or random fiber pads, prefabricated core structures such as honeycombs, and the like. All of the materials, whether restorable or permanently deformable, are physically alterable upon impact by a given exterior force.

U.S. Pat. No. 5,653,358 to Sneddon discloses a multilayer composite pressure vessel with a fitting incorporated in a stem portion thereof. The vessel wall includes a liner, a filament overwrap overwrapping the main portion of the liner for providing structural integrity, the fitting member, and a non-metallic strengthening body localized at and surrounding the stem portion and a portion of the firing member and anchored to the main portion of the pressure vessel between the main portion of the liner and the filament overwrap. The strengthening body includes a body of impregnated filament strengthening material wrapped about the stem portion of the liner and at least a portion of the fitting member. The strengthening body includes a composite of strengthening fibers embedded in a solid matrix of the impregnating material.

U.S. Pat. No. 5,822,838 to Seal et al discloses a high performance, thin metal lined, composite overwrapped pressure vessel. The pressure vessel has multiple layers including a metal liner fabricated from titanium alloy sheet and plate, an adhesive, a composite overwrap which is filament-wound onto the adhesive-covered titanium liner, and a protective coating (epoxy coating) over the overwrap.

U.S. Pat. No. 5,942,070 to Park et al discloses a method for insulating a composite pressure vessel having improved adhesiveness between the insulation and the vessel. The method includes the step of layering up of an uncured carbon fiber fabric/resin prepreg on a mold. An uncured insulating rubber is then layered up and combined with the uncured carbon fiber fabric/resin prepreg by autoclaving.

U.S. Pat. No. 6,190,481 to lida et al discloses a pressure vessel having an outer shell made of a fiber reinforced plastic comprising reinforcing fibers and a resin. The resin impregnated reinforcing fiber bundle is wound around a rotating inner shell at predetermined angles, to thereby form an outer shell.

SUMMARY OF THE INVENTION

In accordance with the invention, an improved coating or laminate for pressure vessels is provided which provides important advantages on prior art composite materials, particularly with respect to impact resistance and fire resistance. Among other advantages, the coating is inexpensive, relatively light in weight and capable of being repaired in the field.

In accordance with one aspect of the invention, there is provided, in a pressure vessel comprising a composite overwrapped pressure vessel including a metal lining and an overwrapped resin composite, the improvement comprising an outer layer of fibers wound thereon in an epoxy matrix resin, said epoxy matrix resin including a plurality of microspheres containing a temperature responsive phase change material which changes phase in response to exposure thereof to a predetermined temperature increase so as to provide increased insulation and heat absorption.

In one preferred embodiment, the wound fibers comprise jute twine although other stronger fibers are preferable for many applications. Advantageously, the microspheres comprise glass microspheres.

According to a further aspect of the invention, there is provided a coating laminate for providing an outer protective coating for a pressure vessel adapted to contain a fluid under pressure, the laminate comprising a plurality of fibers adapted to be wound around the pressure vessel and an epoxy matrix resin for the fibers, said epoxy matrix resin including a plurality of microspheres containing a temperature responsive phase change material which changes phase in response to exposure thereof to a predetermined temperature increase so as to provide increased insulation and heat absorption.

In accordance with yet another aspect of the invention, a method is provided for improving the impact resistance and high temperature resistance of a pressure vessel, the method comprising: winding fiber filaments over the outer surface of the pressure vessel so as to substantially completely cover the outer surface; and applying an epoxy resin to the fiber filaments, said epoxy resin including a plurality of microspheres containing a temperature responsive phase change material.

In one embodiment, the resin is applied to the fiber filaments prior to said winding of said filaments in said pressure vessel and, preferably, the fiber filaments are immersed in a bath of said resin prior to said winding. Alternatively, the resin is applied to the fiber filaments after (or even during) the winding operation.

Further features and advantages of the present invention will be set forth in, or apparent from, the detailed description of preferred embodiments thereof which follows.

DESCRIPTION OF THE PREFERRED EMBODIMENTS

Figure 1:
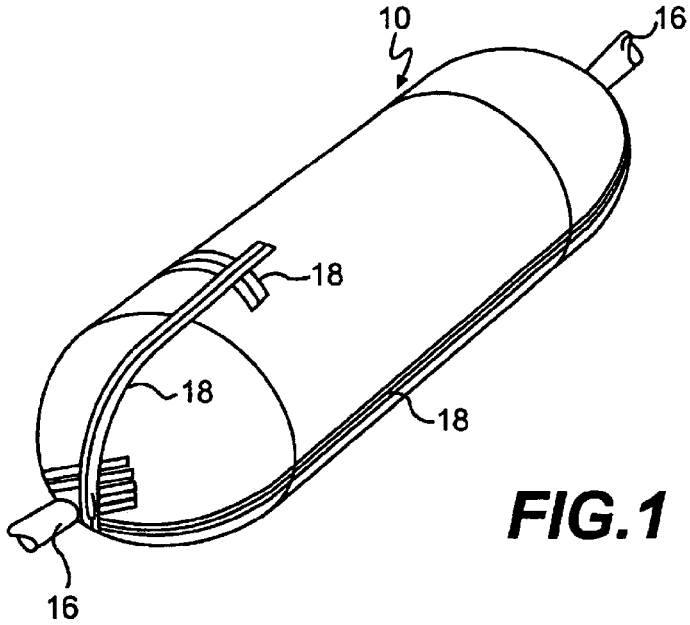
FIG. 1 is a perspective view of a pressure vessel manufactured in accordance with a preferred embodiment of the present invention, shown mounted on winding spindles.
Figure 2:
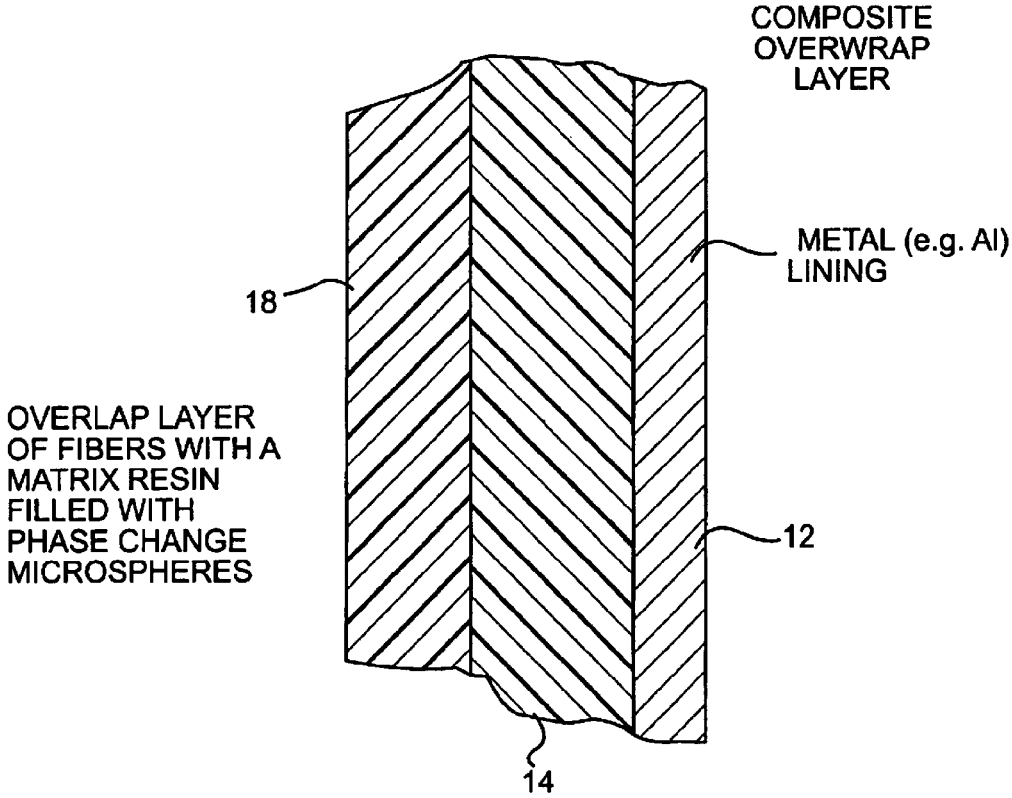
FIG. 2 is cross section of the vessel of FIG. 1, showing, in a highly schematic way, the different layers forming the vessel.

In accordance with the invention, a pressure vessel, such as is indicated at 10 in FIG. 1, is provided which typically comprises, as shown in FIG. 2, a metal (typically aluminum) lining 12 with an overwrapped composite layer 14. The overwrapped layer 14 is typically produced by using a filament winding machine to provide overlapping of the lining 12 with graphite fibers or filaments impregnated with an epoxy matrix resin. There are many suitable resins; EPON 828 and 862 are typical. The resins can already be on, i.e., part of, the fiber (as a pre-preg) or can be wet wound. It will, of course, be understood that pressure vessel 10 may be of other shapes and forms than illustrated in FIG. 1. It will also be appreciated that FIG. 2 is not to scale and, for example, the relative thicknesses shown are not necessarily indicative of those of an actual pressure vessel. It will further be understood that lining 12 and layer 14 are conventional, and that pressure vessels made in this manner are commercially available.

In accordance with the invention, the vessel 10 is again placed in a filament winding machine, represented by mounting spindles 16 in FIG. 1, and overwrapped with a further fiber layer or laminate 18 composed of a different kind of fiber from layer 14. Some of the wound fibers of layer 18 are indicated schematically at 18*a* in FIG. 1. In one preferred embodiment, the fiber is a jute twine with an epoxy matrix filled with glass microspheres containing a phase change material. However, commercially available, proprietary materials such as ZYLON (PBO), VECTRAN (LCP), KEVLAR and the like are better for many applications because, e.g., of their greater strength. The use of jute twine is advantageous because it is relatively inexpensive, adds to the insulating properties of the coating or layer 18 and contributes to providing protection from impact damage. However, it is understood that other twines, fibers or filaments which are capable of retarding heat transfer to the interior portions of the vessel can be used and may be preferred depending on the application. These include, for example, fibers of the types mentioned above.

Advantageously, the epoxy resin is a low temperature material (below 200° F.) that is highly toughened and ductile. Suitable resins for use here include many different epoxy resins as well as other resins such as phenolic resins and urethane resins.

The filled microspheres of layer 18 are important, particularly in adding to protection provided against large changes in temperature. In this regard, the phase change material contained within the microspheres provides insulation and absorbs heat during a phase change thereof (e.g., from a solid to a fluid) in response to the vessel being exposed to a significant temperature increase. The phase change material used can be adapted to, or customized for, the particular application to which the vessel is to be put. As indicated above, the microspheres are preferably made of glass while the phase change material can be any of a number of materials conventionally used for this purpose.

The resin of layer 18 is preferably applied to the fibers thereof by immersing the fibers in a bath of the resin prior to winding of the fibers but, alternatively, can be applied to the fibers when the fibers are wound onto the pressure vessel.

The ability of a pressure vessel with a laminate or layer corresponding to laminate 18 to resist impact and withstand high temperatures without rupture are key advantages of the invention. A further important advantage of the coating, layer or laminate 18 is that, if damaged, it can be readily removed from the vessel and replaced at low cost.

Testing carried out with pressure vessels including a layer or laminate corresponding to layer 18 as described above have performed very well under testing. In an exemplary test wherein a coating or laminate corresponding to layer 18 was applied to a commercially available 3,000 psi pressure or tank and subjected to a DOT "bonfire" test, the coating or laminate allowed the pressure tank to survive the 1500° F. fire for the full duration of the test (15 minutes). It is noted that a typical commercial pressure vessel, without the coating of the invention, explodes dramatically within 2 or 3 minutes. The coated tank, after cooling from the bonfire test, was then hydroproof tested. A hydroproof test is a standard test wherein the tank is pressurized while filled with water. Under the hydroproof test, the coated vessel exploded at the design pressure of the vessel (7,000 psi), thus indicating that the vessel was unaffected by the fire test.

As indicated above, the coating or laminate of the invention is inexpensive, relatively light in weight and can be repaired in the field and while the foregoing discussion has focussed on pressure vessels employed as pressure tanks for automobiles or the like, the coating or laminate of the invention can be used to advantage in other applications such as fuel tanks for boats, in pipelines in off-shore oil wells, and the like.

Although the invention has been described above in relation to preferred embodiments thereof, it will be understood by those skilled in the art that variations and modifications can be effected in these preferred embodiments without departing from the scope and spirit of the invention.

What is claimed is:

1. In a pressure vessel comprising a composite overwrapped pressure vessel including a metal lining and an overwrapped resin composite, the improvement comprising an outer protective layer of fibers wound thereon in an epoxy matrix resin, said epoxy matrix resin including a plurality of microspheres containing a temperature responsive phase change material which changes phase in response to exposure thereof to a predetermined temperature increase so as to provide increased insulation and heat absorption.

2. A pressure vessel as claimed in claim 1 wherein said microspheres comprise glass microspheres.

3. A pressure vessel as claimed in claim 1 wherein said fiber comprises jute twine.

4. A method of improving the impact resistance and high temperature resistance of a pressure vessel including a metal liner and an overwrapped resin composite and having an outer surface, said method comprising:

winding fiber filaments over the outer surface of the pressure vessel so as to substantially completely cover the outer surface; and applying an epoxy resin to the fiber filaments to form a protective layer, said epoxy resin including a plurality of microspheres containing a temperature responsive phase change material.

5. A method as claimed in claim 4 wherein said resin is applied to said fiber filaments prior to said winding of said filaments in said pressure vessel.

6. A method as claimed in claim 5 wherein said fiber filaments are immersed in a bath of said resin prior to said winding.

7. A method as claimed in claim 4 wherein said resin is applied to said fiber filaments after said winding.

8. A method as claimed in claim 4 wherein said fiber filaments comprise jute twine.

* * * * *